US006662814B2

(12) United States Patent
Tobbe et al.

(10) Patent No.: US 6,662,814 B2
(45) Date of Patent: Dec. 16, 2003

(54) MID-LEVEL SPRAY-ARM ASSEMBLY

(75) Inventors: Joseph Duane Tobbe, Taylorsville, KY (US); Jesse A. Curran, Versailles, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/754,538

(22) Filed: Jan. 5, 2001

(65) Prior Publication Data

US 2003/0005950 A1 Jan. 9, 2003

(51) Int. Cl.[7] ..... B08B 3/02; B08B 3/00

(52) U.S. Cl. ..... 134/176; 134/179; 239/113; 239/261; 239/264

(58) Field of Search ..... 134/56 D, 57 D, 134/58 D, 144, 148, 176, 179; 239/113, 251, 261, 264

(56) References Cited

U.S. PATENT DOCUMENTS

| | | | | |
|---|---|---|---|---|
| 3,841,342 A | | 10/1974 | Cushing et al. | 134/144 |
| 3,951,684 A | | 4/1976 | LaPrad et al. | 134/144 |
| 3,969,137 A | | 7/1976 | Jenkins et al. | 134/176 |
| 3,989,054 A | | 11/1976 | Mercer | 134/104 |
| 4,172,463 A | | 10/1979 | Wolley et al. | 134/176 |
| 4,266,565 A | | 5/1981 | Gurubotham | 134/144 |
| 4,301,822 A | | 11/1981 | Dingler | 134/176 |
| 4,418,868 A | | 12/1983 | Gurubatham et al. | 239/228 |
| 4,509,687 A | | 4/1985 | Cushing | 239/245 |
| 4,991,611 A | | 2/1991 | Jarvis et al. | 134/179 |
| 5,330,102 A | * | 7/1994 | Jarvis et al. | 239/228 |
| 5,662,744 A | * | 9/1997 | Tuller et al. | 134/25.2 |
| 5,752,533 A | * | 5/1998 | Edwards | 134/176 |
| 5,954,073 A | | 9/1999 | Tobbe et al. | 134/176 |

* cited by examiner

*Primary Examiner*—Randy Gulakowski
*Assistant Examiner*—Joseph Perrin
(74) *Attorney, Agent, or Firm*—George L. Rideout, Jr., Esq.; Armstrong Teasdale, LLP

(57) ABSTRACT

A mid-level spray-arm assembly for a dishwasher includes a bracket for mounting a spray-arm hub to an upper rack of the machine, and a bearing coupling extending between the hub and the bracket. The bearing coupling forms a first bearing surface for rotation of the bearing coupling relative to the bracket, and a second bearing surface for rotation of the spray-arm relative to the bearing coupling. Thus, redundant bearing surfaces are provided that facilitate a more even wearing of the bearing surfaces and allow rotation of the spray-arm even when one of the bearing surfaces fails.

18 Claims, 5 Drawing Sheets

MID-LEVEL SPRAY-ARM ASSEMBLY

BACKGROUND OF THE INVENTION

This invention relates generally to spray-arms, and, more particularly, to spray-arm assemblies for dishwashers.

One type of domestic dishwasher includes a lower spray-arm mounted in a lower region of a wash chamber, and a mid-level spray-arm mounted above the lower spray-arm. See, for example, U.S. Pat. No. 3,969,137. Typically, the lower spray-arm sprays water upward over dishware and items to be cleaned in a lower rack, and the mid-level spray-arm sprays water upward over dishware and items to be cleaned in an upper rack. A pump injects water into the lower spray-arm for rotary motion thereof, and further directs a stream of water through the lower spray-arm for θ receipt by the mid-level spray-arm and for imparting rotary motion to the mid-level spray-arm. The mid-level spray-arm is mounted to the upper rack, and a sealed retractable tower coupled to the lower spray-arm delivers water from the lower spray-arm to the mid-level spray-arm when water pressure reaches pre-determined levels. The mid-level spray-arm rotates or spins relative to the upper rack upon a bearing surface.

The bearing surface of the mid-level spray-arm, however, tends to wear unevenly. Uneven wear of the bearing surface can lead to impaired performance of the spray-arm and premature jamming and failure of the bearing surface which may prevent the mid-level spray-arm from rotating. In addition, sealing the connection of the retractable tower to the upper and lower racks adds to the cost and complexity of the spray-arms, and consequently increases manufacturing and assembly costs. Still further, known mid-level spray-arms tend to generate considerable noise from spray-arm water jets that impact side walls of the washing chamber.

Accordingly, it would be desirable to provide a mid-level spray-arm assembly that promotes more even wear of the bearing surface, thereby extending the bearing life of the spray-arm. It would also be desirable to provide a mid-level spray-arm bearing that reduces instances of jamming. Further, it would be desirable to eliminate sealed spray-arm connections to reduce manufacturing costs of dishwashers. Also, it would be desirable to provide a quieter operating spray-arm.

BRIEF SUMMARY OF THE INVENTION

In an exemplary embodiment of the invention, a dishwasher mid-level spray-arm assembly includes a spray-arm, a bracket for supporting the spray-arm on an upper rack of the dishwasher, and a bearing for coupling the bracket and spray-arm and that forms a first bearing surface for rotation of the bearing coupling relative to the bracket and a second bearing surface for rotation of the spray-arm relative to the bearing coupling. The first and second bearing surfaces promote a more even wear of the bearing surface, and further allow rotation of the spray-arm even when one of the bearing surfaces fails or jams.

More specifically, the spray-arm includes a hub having an outer surface and a hub slot. The bracket includes an inner surface and a bracket slot, and the bearing coupling is retained partially in the hub slot and partially in the bearing slot. The coupling is an annular disk clip partially retained in the hub slot and partially retained in the bracket slot. A small gap separates the bracket inner surface from the hub outer surface to substantially eliminate frictional engagement of the bracket inner surface and the hub outer surface, and relative rotational movement of the bearing coupling and bracket, and also relative rotation of the spray-arm hub and the bearing coupling is accomplished on smooth first and second bearing surfaces.

The spray-arm hub includes a funnel that accommodates an off-centering or misalignment of the spray-arm with respect to a retractable tower that supplies water to the mid-level spray-arm, and also includes angled fluid discharge ports arranged so that spray-arm water jets do not impact side walls of a dishwasher wash chamber during washing operation. Specifically, a spray pattern of the mid-level spray-arm is substantially confined within a lower outer perimeter of the upper rack of the dishwasher, and items placed at the lower outer perimeter intercept the outer perimeter of the spray pattern and prevent water from impacting the side walls of the wash chamber. Noise from excitation of the wash chamber side walls is considerably reduced and a noticeably quieter operating dishwasher is realized.

The spray-arm assembly is easily assembled with snap-fit engagement of the bearing coupling to the bracket, and snap-fit engagement of the bracket and coupling to the spray-arm hub. Thus, a long life, easily assembled spray-arm assembly is provided.

DETAILED DESCRIPTION OF THE INVENTION

Figure 1:
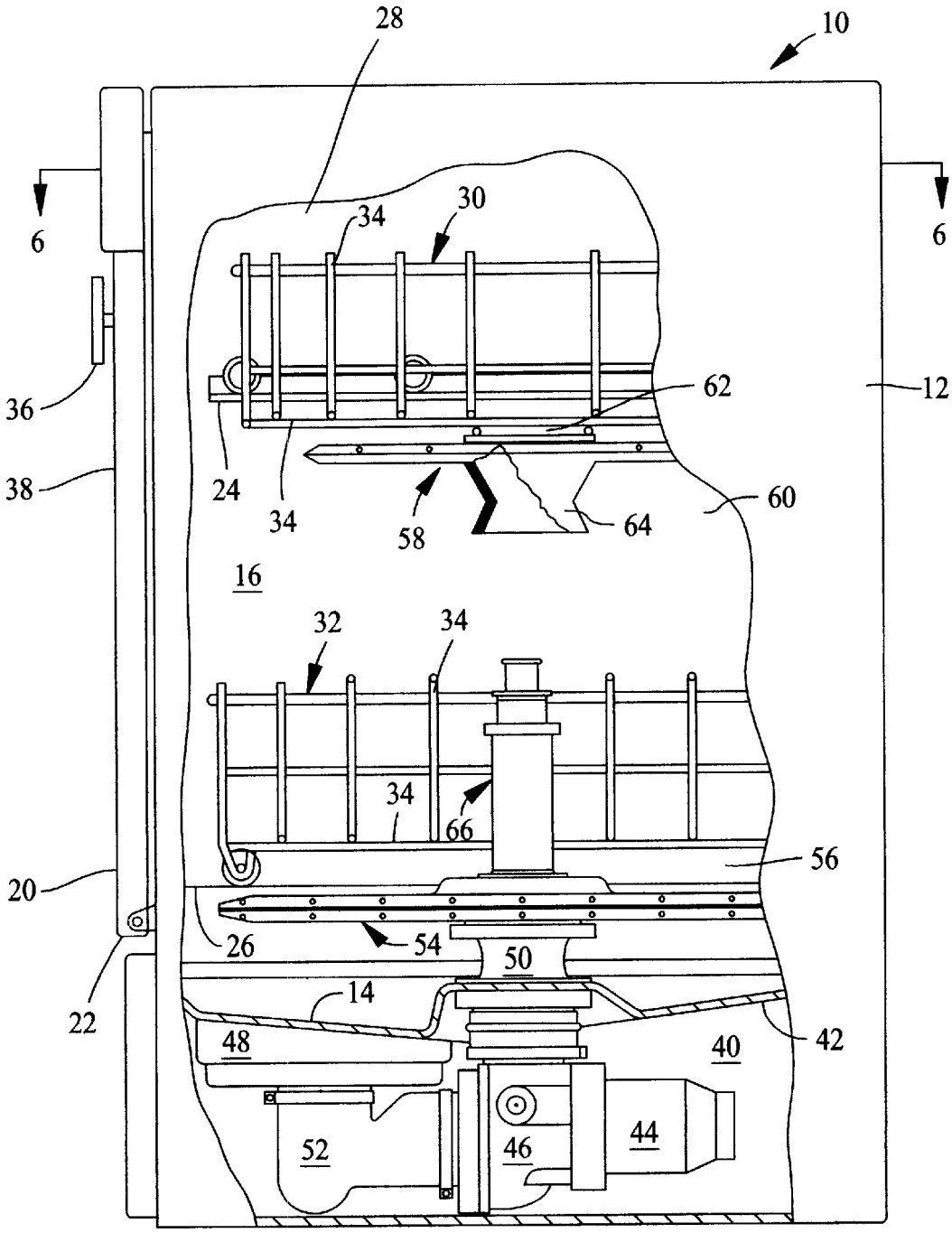
FIG. 1 is a side elevational view of a dishwasher partially broken away and including a mid-level spray-arm assembly.

FIG. 1 is a side elevational view of an exemplary conventional domestic dishwasher 10 partially broken away, the construction and operation of which is well known in the art, and in which the present invention may be practiced. It is contemplated, however, that the invention may be practiced in other types of dishwashers beyond the dishwasher 10 described and illustrated herein. Accordingly, the following description is for illustrative purposes only, and the invention is in no way limited to use in a particular type dishwasher, such as dishwasher 10.

Dishwasher 10 includes a cabinet 12 having a tub 14 therein and forming a wash chamber 16. Tub 14 includes a front opening (not shown in FIG. 1) and a door 20 hinged at its bottom for movement between a normally closed vertical position (shown in FIG. 1) and a horizontal open position (not shown). Upper and lower guide rails 24, 26 are mounted on tub side walls 28 and accommodate upper and lower roller-equipped racks 30, 32, respectively. Each of upper and lower racks 30, 32 is fabricated from known materials into lattice structures including a plurality of elongate members 34, and each rack 30, 32 is adapted for movement between an extended loading position (not shown) in which the rack is substantially positioned outside wash chamber 16, and a retracted position (shown in FIG. 1) in which the rack is located inside wash chamber 16. Conventionally, a silverware basket (not shown in FIG. 1) is removably attached to lower rack 32 for placement of silverware, utensils, and the like that are too small to be accommodated by upper and lower racks 30, 32.

A control input selector 36 is mounted at a convenient location on an outer face 38 of door 20 and is coupled to known control circuitry (not shown) and control mechanisms (not shown) for operating dishwasher system components located in a machinery compartment 40 below a bottom 42 of tub 14. An electric motor 44 drivingly coupled to a pump 46 provides for circulation of water from a sump portion 48 of tub 14 to a water discharge pipe 50. An inlet pipe 52 connects sump 48 to an inlet (not shown) of pump 46, and pump 46 includes a discharge conduit (not shown) that communicates in flow relationship with a building plumbing system (not shown).

A lower spray-arm-assembly 54 is rotatably mounted within a lower region 56 of wash chamber 16 and above tub bottom 42 so as to rotate in relatively close proximity to lower rack 32. A mid-level spray-arm assembly 58 is located in an upper region 60 of wash chamber 16 and is rotatably attached to upper rack 30 in close proximity thereto and at a sufficient height above lower rack 32 to be above a largest item, such as a dish or platter (not shown), that is expected to be washed in dishwasher 10. Mid-level spray-arm assembly 58 includes a central hub 62 and a downwardly projecting funnel 64 for receiving a water stream through a retractable tower 66 of lower spray-arm assembly 54 without retractable tower 66 sealingly engaging mid-level spray-arm assembly 58. Mid-level spray-arm funnel 64 facilitates a degree of off-centering or misalignment of mid-level spray-arm 58 with respect to retractable tower 66 as water from retractable tower 66 impacts funnel 64. Thus, precise positioning of mid-level spray-arm 58 vis-a-vis retractable tower 66 is avoided. Retractable tower 66 is mounted to lower-spray-arm assembly 54 and therefore rotates with lower spray-arm assembly 54 as dishwasher 10 is used, thereby eliminating sealing problems in connections between retractable tower 66 and lower spray-arm assembly 54.

Both lower and mid-level spray-arm assemblies 54, 58 include an arrangement of discharge ports or orifices for directing washing liquid upwardly onto dishes located in upper and lower racks, respectively. The arrangement of the discharge ports provides a rotational force by virtue of washing fluid action through the discharge ports. The resultant rotation of the spray-arm provides coverage of dishes and other dishwasher contents with a washing spray.

Figure 2:
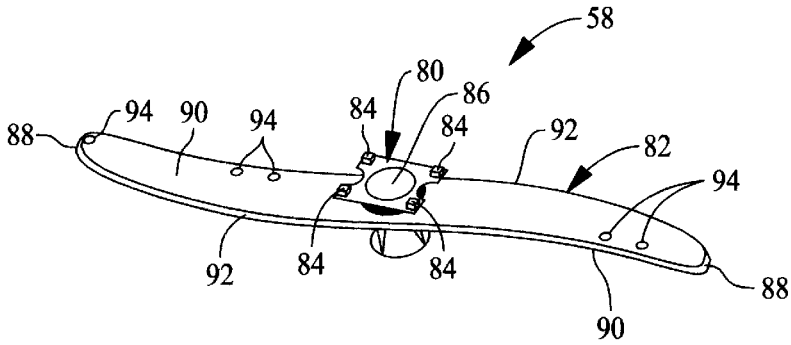
FIG. 2 is a perspective view of the mid-level spray-arm assembly shown in FIG. 1.

FIG. 2 is a perspective view of mid-level spray-arm assembly 58 including a bracket 80 attached to central hub 62 (not shown in FIG. 2) of spray-arm 82. Bracket 80 includes four attachment members 84 depending from a shroud 86 inserted over spray-arm hub 62 for receiving elongate members 34 (shown in FIG. 1) of upper rack 30 (shown in FIG. 1). Thus, bracket 80 may be removably attached to upper rack 30 by inserting rack elongate members 34 within bracket attachment members 84 to support spray-arm 82 below lower rack 32. Spray-arm 82 includes opposite ends 88 and a contoured surface 90 defined by ends 88 and opposite side edges 92. Discharge ports or orifices 94 are asymmetrically located on contoured surface 90 generate a torque about spray-arm hub 62 when washing fluid is sprayed through discharge ports 94, causing spray-arm 82 to rotate within bracket 80, as further described below.

Figure 3:
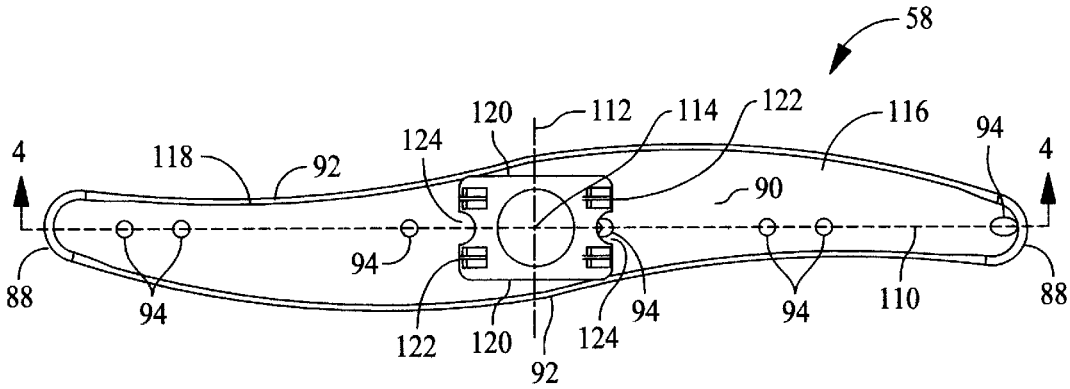
FIG. 3 is a top plan view of the mid-level spray-arm assembly shown in FIG. 2.

FIG. 3 is a top plan view of mid-level spray-arm assembly 58 including a longitudinal axis 110 and a lateral axis 112. Contoured surface 96 is inversely bilaterally symmetrical about both axes 110, 112, i.e., contoured surface 90 is a reverse mirror image about axes 110, 112. Each side edge 92 is partly curved toward and partly curved away from longitudinal axis 110 between opposite rounded ends 88. Discharge ports 94 are substantially aligned along longitudinal axis 110 at varying distances from a center 114 of spray-arm 114. In one embodiment, four discharge ports 94 are located on a first side 116 of spray-arm 82, and three discharge ports 94 are located on a second side 118 of spray-arm 82. Bracket 80 includes opposite longitudinal side edges 120 substantially straight and parallel to longitudinal axis 110, and opposite lateral side edges 122 connecting longitudinal side edges 120. Bracket lateral side edges 122 include rounded cutouts 124 approximately centered between bracket longitudinal side edges 120 to provide clearance for discharge ports 94 located adjacent or beneath bracket 80 when bracket 80 is attached to spray-arm 82.

Figure 4:
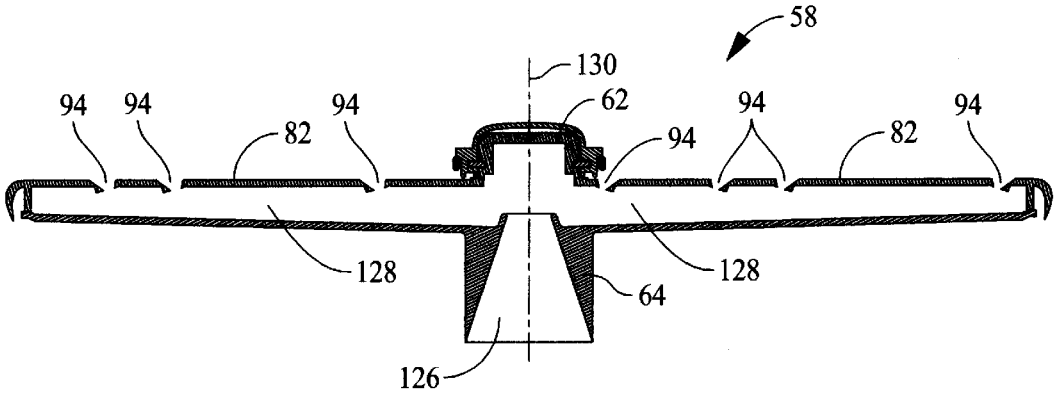
FIG. 4 is a cross sectional view of the mid-level spray-arm assembly along line 4—4 of FIG. 3.

FIG. 4 is a cross sectional view of mid-level spray-arm assembly 58 including funnel 64 depending below spray-arm 82 and substantially aligned with spray-arm hub 62. Funnel 64 includes a conical shaped opening 126 to direct water from lower spray-arm retractable tower 66 (shown in FIG. 1) toward a central passageway 128 extending through spray-arm 82, and further to channel-water to central passageway 128 when retractable tower 66 is misaligned with a vertical axis 130 of spray-arm 82. When a fluid flow rate and pressure entering funnel opening 126 reach sufficient levels, spray-arm central passageway 128 fills with washing fluid and jets of washing fluid are sprayed through discharge parts 94. Due to the placement of discharge ports 94 in spray-arm 82, fluid action through discharge ports 94 rotates spray-arm 82 about vertical axis 130. Rotation of spray-arm 82 creates a swirling spray pattern over wash items placed on upper rack 30 (shown in FIG. 1).

Figure 5:
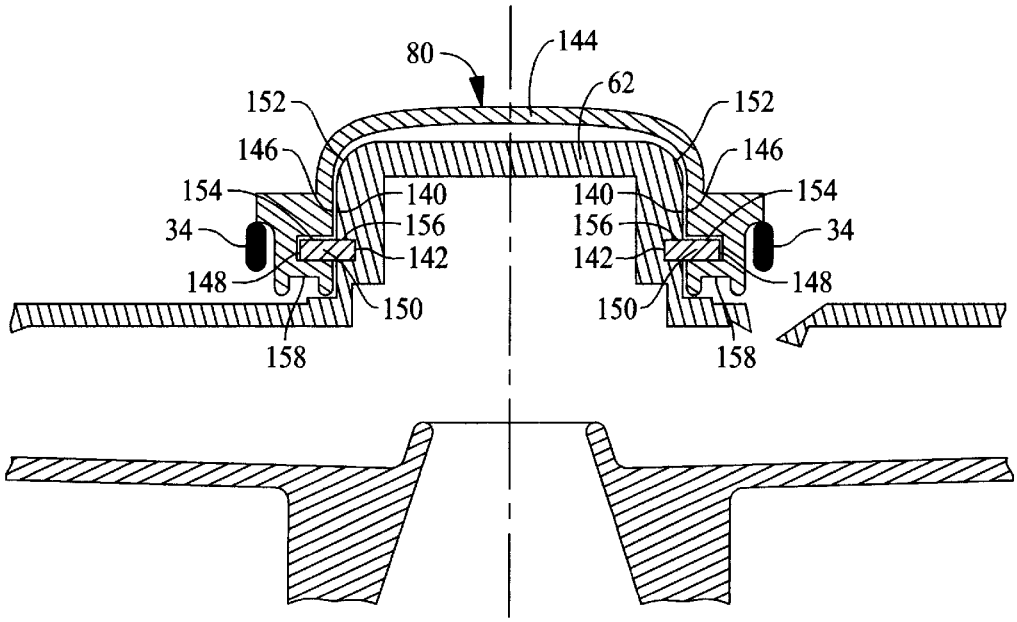
FIG. 5 is an enlarged view of a portion of FIG. 4.

FIG. 5 is an enlarged view of spray-arm central hub 62 and attachment of bracket 80 thereto. Hub 62 includes a generally cylindrical outer surface 140 and a slot 142 therein. Bracket 80 includes a shroud 144 enveloping hub outer surface 140 and including an inner surface 146 and a slot 148 therein that is substantially aligned with hub slot 142. A bearing coupling 150 extends between hub outer surface 140 and bracket inner surface 146 and is partially retained in the respective slots 142, 148 of hub outer surface 140 and bracket inner surface 146. In one embodiment, bearing coupling 150 is a substantially flat annular disk clip that is snap-fit over hub outer surface 140. Bearing coupling 150 is fabricated, in one embodiment, from plastic, but in alternative embodiments is fabricated from other suitable materials known in the art.

Bearing coupling 150 is dimensioned so that it is slightly smaller than a combined area of respective slots 142, 148 of hub outer surface 140 and bracket inner surface 146. That is, bearing coupling 150 is loosely fitted with respect to both spray-arm hub 62 and bracket 80 to allow relative rotational movement of bearing coupling 150 with respect to both spray-arm hub 62 or bracket 80, but yet forms an adequate connection between bracket 80 and hub 62 to prevent separation of spray-arm hub 62 and bracket 80 in use. Hub outer surface 140 and bracket inner surface 142 are separated by a small gap 152 to substantially avoid friction between hub outer surface 140 and bracket inner surface 146.

Bearing coupling 150 forms a first bearing surface 154 that allows relative movement of spray-arm hub 62 with respect to bearing coupling 150, and a second bearing surface 156 that allows relative movement of bearing coupling 150 with respect to bracket 80 when bracket attachment members 84 (shown in FIG. 2) are hung on upper rack elongate members 34 (shown in FIG. 1). First and second bearing surfaces 154, 156 allow rotation of bearing coupling 150 with respect to both spray-arm hub 62 and bracket 80 promote a more even wear of bearing surfaces 154, 156 relative to conventional single-bearing surface spray-arms. Thus, an operating life of mid-level spray-arm assembly 58 is extended relative to known spray-arm systems. Further, first and second bearing surfaces 154, 156 allow for rotation of spray-arm 82 relative to bracket 80 even when one of bearing surfaces 154, 156 jams or fails. By providing a redundant bearing surfaces 154, 156, spray-arm 82 is prevented from rotating or turning only when both bearing surfaces 154, 156 jam or fail concurrently, thereby considerably reducing instances of spray-arm lock.

Lower extensions 158 of bracket 80 extend below bracket slot 148 to substantially prevent water and wash fluid from splashing onto bearing surfaces 154, 156 and therefore effectively water seal bearing coupling 150.

Mid-level spray-arm assembly 54 is easily assembled by inserting bearing coupling 150 into bracket inner surface slot 148, and inserting bracket 80 and bearing coupling 150 over spray-arm hub 62 until bearing coupling 150 snaps into hub outer surface slot 142. Spray-arm 82 is then snapped onto upper rack 30 (shown in FIG. 1) by inserting bracket attachment members 84 (shown in FIG. 2) over elongate rack members 34.

Figure 6:
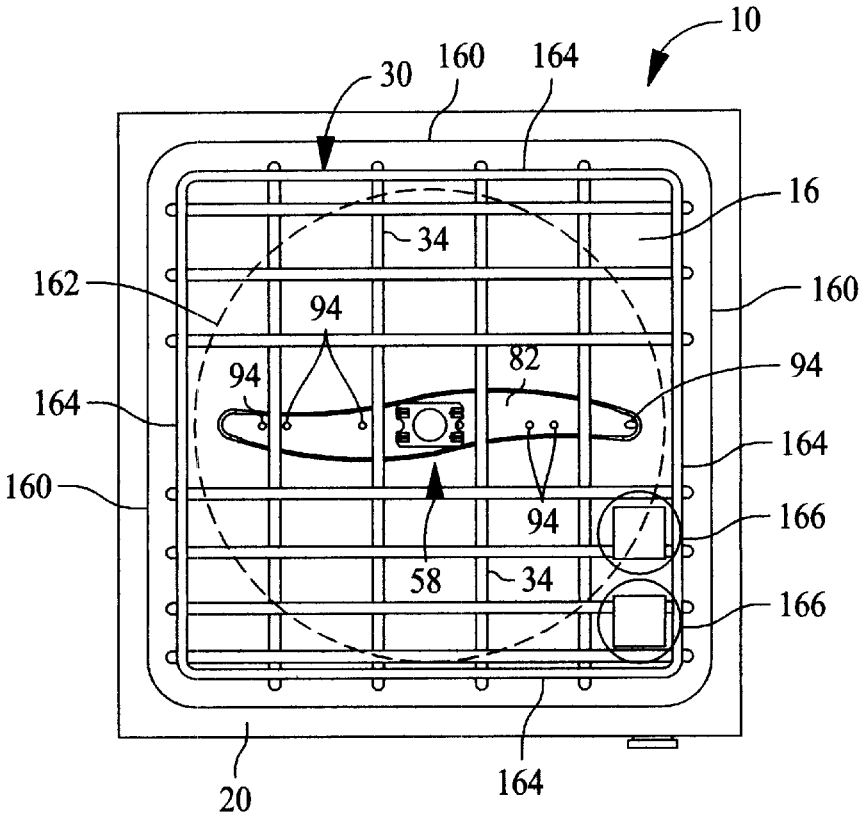
FIG. 6 is a partial cross sectional view of the dishwasher shown in FIG. 1 along line 6—6.

FIG. 6 is a partial cross sectional view of dishwasher 10 illustrating a noise reducing feature of mid-level spray-arm assembly 58. Upper rack 30 is situated between side walls 160 of wash chamber 16 and mid-level spray-arm assembly 58 is mounted to rack elongate members 34 so that mid-level spray-arm 82 is suspended beneath upper rack. 30. When door 20 is closed and dishwasher 10 is operated, retractable tower 66 (shown in FIG. 1) feeds water to mid-level-spray-arm 82 and causes spray-arm 82 to rotate about vertical axis 130 (shown in FIG. 4). As mid-level spray-arm 82 rotates, jets of water are sprayed through spray-arm fluid discharge ports 94 to form a swirling spray pattern having a substantially circular outer perimeter 162 (shown in phantom in FIG. 6) that is as large as possible without exceeding or crossing a lower outer perimeter 164 of upper rack 30. When upper rack 30 is properly loaded, such as with glasses 166, water jets sprayed from mid-level spray-arm 82 are intercepted and prevented from impacting wash chamber side walls 160.

Figure 7:
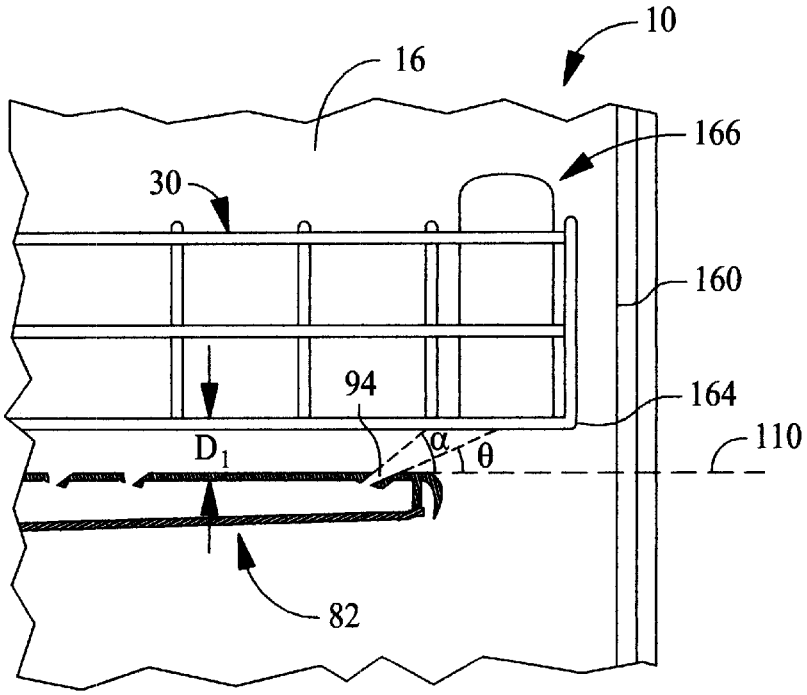
FIG. 7 is a partially broken away view of a portion of the dishwasher of FIG. 1.

FIG. 7 is a partially broken away view of a portion of dishwasher 10 illustrating midlevel spray-arm 82 extending below upper rack 30 within wash chamber 16. An outermost fluid discharge port 94 of mid-level spray-arm 82 is constructed to include first and second angles $\alpha$ and $\theta$ with respect to spray-arm longitudinal axis 110 so that a water jet (not shown) sprayed through discharge port 94 is intercepted by the contents of upper rack 30, such as by glass 166. Therefore, when upper rack 30 is properly loaded with items appropriately placed around upper rack outer perimeter 164, the items are cleaned with water jets from mid-level spray-arm 82, while wash tube side walls 160 are substantially free from water jet impact that excites wash tub side walls 160, thereby eliminating an appreciable component of noise generated by dishwasher 10 in use.

In one embodiment, angle $\theta$ is approximately 40°, and angle $\alpha$ is approximately 70' to provide an adequately broad spray jet while minimizing noise from excitation of wash tub side walls 160. It is contemplated that other values of $\alpha$ and $\theta$ may be selected in alternative embodiments to satisfy particular operational conditions of specific dishwasher systems, including but not limited water pressure, the relative sizes of upper rack 30 and mid-level spray-arm 82, and a vertical distance $D_1$ that separates upper rack 30 and mid-level spray-arm 82.

Figure 8:
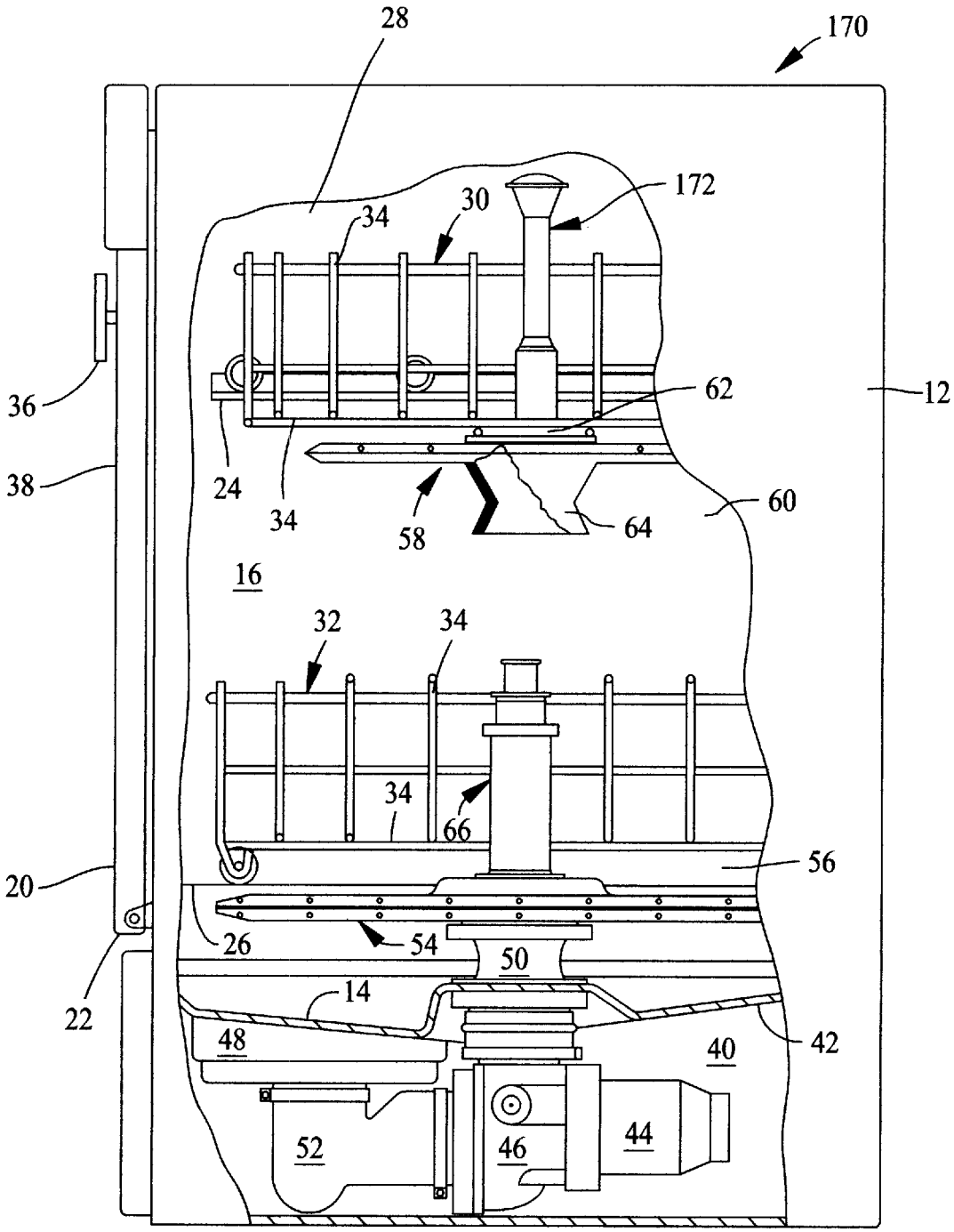
FIG. 8 is a side elevational view of a second embodiment of a dishwasher partially broken away and including a mid-level spray-arm assembly.

FIG. 8 is a side elevational view of a second embodiment of a dishwasher similar to dishwasher 10 (shown in FIGS. 1, 6 and 7) but including a known third level, or upper level washing element 172 that receives water from mid-level spray-arm assembly 58 and sprays fluid downward over upper rack 30 for added cleaning effectiveness. A variety of third level washing elements are known in the art, and the present invention is not restricted to practice with a particular third level washing element.

Thus, an easily assembled, longer life mid-level spray-arm assembly is provided that extends bearing life relative to known spray-arms, and reduces instances of jammed or inoperable spray-arms due to failed bearing surfaces. The mid-level spray-arm assembly also facilitates quieter operating dishwashers that foster a more pleasant operating environment in the home.

While the invention has been described in terms of various specific embodiments, those skilled in the art will recognize that the invention can be practiced with modification within the spirit and scope of the claims.

What is claimed is:

1. A dishwasher comprising:

a cabinet;

a rack slidably mounted within said cabinet;

a first spray-arm assembly mounted to said rack and comprising an arrangement of fluid discharge ports, said first spray-arm assembly comprises a funnel, a hub, a bracket for supporting said spray-arm on said rack, and a bearing coupling extending between said hub and said bracket, said bracket comprises a shroud enclosing said hub, said bearing coupling forming a first bearing surface for rotation of said bearing coupling relative to said bracket and a second bearing surface for rotation of said spray-arm relative to said bearing coupling;

a retractable tower mounted in said cabinet; and a pump for delivering water to said retractable tower so tat water flows through said tower to said first spray-arm assembly, said first spray-arm assembly adapted to channel water from said retractable tower to said fluid discharge ports when said retractable tower and said first spray-arm are misaligned, said first spray-arm channels water from said retractable tower without engaging said retractable tower and without self centering.

2. A dishwasher in accordance with claim 1 wherein said retractable tower is separated from said funnel when said pump is operated to deliver water from said retractable tower to said funnel.

3. A dishwasher in accordance with claim 1 wherein said hub comprises an outer surface and a hub slot therein, said bearing coupling extending partially within said hub slot.

4. A dishwasher in accordance with claim 3 wherein said bracket comprises an inner surface and a bracket slot therein, said bearing coupling extending partially within said bracket slot.

5. A dishwasher in accordance with claim 4 wherein said coupling comprises an annular disk.

6. A dishwasher in accordance with claim 1 wherein, said cabinet comprises a wash chamber comprising at least one side wall, said first-spray-arm configured so that fluid from said first spray-arm is substantially contained in within said rack and away from said side wall.

7. A dishwasher in accordance with claim 6 wherein said rack comprises an outer perimeter, said first spray-arm comprises a plurality of fluid discharge ports configured to create a spray pattern, said spray pattern confined within said rack outer perimeter.

8. A dishwasher in accordance with claim 7 wherein said first spray-arm comprises a longitudinal axis and an outermost fluid discharge port, said outermost fluid discharge oriented at an angle θ with respect to said longitudinal axis.

9. A dishwasher in accordance with claim 8 wherein θ is substantially 40°.

10. A dishwasher comprising:

a rack comprising an outer perimeter; and a first spray-arm assembly mounted to said rack and configured for creating a spray pattern, said spray pattern confined within at least said rack lower outer perimeter, said first spray-arm assembly comprises a hub, a bracket for supporting said first spray-arm assembly on said rack and a bearing coupling extending between said hub and said bracket, said hub includes an outer surface and a hub slot therein, said bearing coupling extending partially within said hub slot, said bracket includes an inner surface and a bracket slot therein, said bearing coupling extending partially within said bracket slot, said bearing coupling forming a first bearing surface for rotation of said bearing coupling relative to said bracket and a second bearing surface for rotation of said spray-arm relative to said bearing coupling.

11. A dishwasher in accordance with claim 10 wherein said first spray-arm assembly comprises a spray arm comprising a longitudinal axis and an outermost fluid discharge port, said outermost fluid discharge port oriented at an angle θ with respect to said longitudinal axis.

12. A dishwasher in accordance with claim 11 wherein θ is substantially 40°.

13. A dishwasher in accordance with claim 10 further comprising:

a second spray-arm assembly comprising a retractable tower mounted stationary thereto; and a pump for imparting rotary motion to said second spray arm and for delivering water to said first-spray arm through said retractable tower, thereby imparting rotary motion to said first spray-arm.

14. A dishwasher in accordance with claim 11 wherein said first spray-arm is configured to accommodate misalignment of said first spray-arm with respect to said retractable tower.

15. A dishwasher in accordance with claim 14 wherein said first-spray arm comprises a funnel.

16. A dishwasher in accordance with claim 1 wherein said coupling comprises an annular disk.

17. A dishwasher in accordance with claim 10 wherein said bracket comprises a shroud, said shroud enclosing said hub.

18. A dishwasher in accordance with claim 10 wherein said wherein said rack outer perimeter comprises an outer perimeter at a lower end of said rack.

* * * * *

UNITED STATES PATENT AND TRADEMARK OFFICE

CERTIFICATE OF CORRECTION

PATENT NO. : 6,662,814 B2
DATED : December 16, 2003
INVENTOR(S) : Tobbe et al.

It is certified that error appears in the above-identified patent and that said Letters Patent is hereby corrected as shown below:

Column 6,
Line 46, delete “so tat” and insert therefor -- so that --.

Column 7,
Line 4, delete “in within” and insert therefor -- within --.

Column 8,
Line 24, delete “claim 1” and insert therefor -- claim 10 --.
Line 30, delete “wherein said” (2nd occurrence).

Signed and Sealed this

First Day of June, 2004

JON W. DUDAS
*Acting Director of the United States Patent and Trademark Office*